US007497238B2

(12) United States Patent
Williams

(10) Patent No.: US 7,497,238 B2
(45) Date of Patent: Mar. 3, 2009

(54) APPARATUS AND METHOD FOR CUTTING WORKPIECE

(76) Inventor: Alan Williams, 2228 Portage St., Kalamazoo, MI (US) 49001

( * ) Notice: Subject to any disclaimer, the term of this patent is extended or adjusted under 35 U.S.C. 154(b) by 0 days.

(21) Appl. No.: 11/218,323

(22) Filed: Sep. 1, 2005

(65) Prior Publication Data

US 2006/0086418 A1 Apr. 27, 2006

Related U.S. Application Data

(63) Continuation-in-part of application No. 10/914,346, filed on Aug. 9, 2004.

(51) Int. Cl.
*B27C 5/00* (2006.01)

(52) U.S. Cl. ..... 144/144.52; 144/145.2; 83/468.4

(58) Field of Classification Search ..... 144/144.1, 144/144.51, 144.52, 145.1; 83/574, 483–486, 83/468.4, 468.7
See application file for complete search history.

(56) References Cited

U.S. PATENT DOCUMENTS 4,489,634 A * 12/1984 Volk ..... 83/522.28
4,516,453 A * 5/1985 Parham, Jr. ..... 83/471.3
4,621,427 A * 11/1986 Bergler ..... 30/481
4,735,531 A * 4/1988 Boerckel et al. ..... 409/182
5,052,454 A * 10/1991 Meinhardt ..... 144/144.51
5,333,385 A * 8/1994 Chou ..... 30/371
5,394,781 A * 3/1995 Tsubai ..... 83/449
5,577,428 A * 11/1996 Rueb ..... 83/449
5,647,420 A * 7/1997 Michell ..... 144/286.1
5,893,402 A * 4/1999 Darling ..... 144/372
6,079,309 A * 6/2000 Molburg ..... 83/745
6,116,304 A * 9/2000 Wilson et al. ..... 144/154.5
6,484,767 B2 * 11/2002 Cameron ..... 144/154.5
6,990,882 B2 * 1/2006 Schonfelder ..... 83/467.1
2003/0145706 A1 * 8/2003 Jordan ..... 83/468.4
2003/0221530 A1 * 12/2003 Logan et al. ..... 83/468.4

* cited by examiner

*Primary Examiner*—Shelley Self

(57) ABSTRACT

Apparatus and method for use with a power saw or router in cutting workpieces to form a lap joint or a routed groove, involves at least one channel-forming member forming an elongated channel having an open side to receive at least one workpiece and having a cutter-receiving opening, and one or more guides on the channel-forming member and extending in a direction transverse to the channel so as to guide a saw or router in a manner that a cutter thereof is guided to cut across the workpiece residing in the channel.

19 Claims, 8 Drawing Sheets

APPARATUS AND METHOD FOR CUTTING WORKPIECE

This application is a continuation-in-part of Ser. No. 10/914,346 filed Aug. 9, 2004, and claims benefits and priority thereof.

FIELD OF THE INVENTION

The present invention relates to apparatus and method for cutting a workpiece to form a lap joint or to form a routed region on a workpiece.

BACKGROUND OF THE INVENTION

In the construction of homes, apartments, offices, and other buildings, the use of lap joints is common to provide an asethetically pleasing joint between abutting end regions of adjacent wooden or plastic workpieces. For example, in finishing the interior of a building, lap joints are provided between abutting wall moldings, chair railing, wainscoting railing, and the like to impart a pleasing appearance to the joint. In finishing the exterior of a building, lap joints are provided between abutting siding boards, fascia boards, deck boards, and the like to this same end.

In the past, a carpenter installing wall molding, chair railing, or wainscoting railing, typically would measure the wall for dimension and attempt to cut two separate molding or railing pieces to proper dimension with an angled cut at the ends thereof to be overlapped to form a lap joint when the molding or railing pieces are fastened to the wall. However, for even a skilled carpenter, the measuring and cutting of the separate molding or railing pieces sometimes occurs in a trial and error manner in order to achieve the desired aesthetically pleasing lap joint after the pieces are fastened on the wall. For example, should the measured dimension and/or angled cutting be in error even to a small extent, then the resulting lap joint between the molding or railing pieces after fastening on the wall is less than visually appealing and may require recutting additional molding or railing pieces and/or in touching-up of the lap joint with filler, both of which are time consuming and add to the cost of installing the molding or railing on the wall.

Moreover, in construction of shelving and other structures, the sides of one or more workpieces can be routed out using a power router to form a groove or routed region in a side of workpeice in order to receive an interconnecting member such as a shelf board.

SUMMARY OF THE INVENTION

The present invention provides apparatus for use with a saw, router or other cutting tool to cut a workpiece wherein the apparatus guides movement of the cutting tool relative to the workpiece.

In one embodiment of the present invention, apparatus is provided for use with a saw to cut overlapped regions of workpieces that include, but are not limited to, molding, boards, siding, decking, and the like, to form a lap joint therebetween in a manner that overcomes the disadvantages of the past cutting techniques. An embodiment of the invention provides an apparatus for use with a saw in cutting workpieces to form a lap joint wherein the apparatus comprises at least one channel-forming member forming an elongated channel having an open side to receive the overlapped regions of first and second workpieces and having a saw blade-receiving opening. One or more saw guides are disposed on the at least one channel-forming member and extend in a direction transverse, preferably substantially perpendicular, to the channel so as to receive a saw in a manner that a cutting blade of the saw is guided to cut across the overlapped regions residing in the channel.

In a preferred apparatus embodiment of the invention, one or more saw guides connect first and second channel-forming members together in a manner that a width of the channel is adjustable to accommodate workpieces of different widths. The distance between the saw guide members optionally can be adjustable to accommodate different sized power saws.

A method embodiment of the present invention for forming a lap joint involves securing first and second workpieces on a surface with adjacent end regions of the workpieces overlapping one another and being unsecured, cutting across the overlapped end regions to cut complementary lap joint-forming surfaces on the end regions, and positioning the lap joint-forming surfaces together to form a lap joint on the surface. This embodiment is advantageous to form a lap joint in-situ on a surface, which can be an interior wall, exterior wall, or floor of a building.

Another method embodiment of the present invention involves forming a lap joint by cutting across overlapping end regions of the workpieces using a saw blade set at a cutting angle effective to cut across the overlapped end regions without a gap being formed at the joint due to the width of the saw blade. This embodiment is advantageous to form a gapless lap joint at the adjacent end regions of the workpieces.

In another embodiment of the present invention, the apparatus is provided for use with a router to form a routed region in a workpiece wherein the router is guided by the apparatus.

Other advantages of the present invention will become apparent from the following drawings taken with the following detailed description of the invention.

DETAILED DESCRIPTION OF THE INVENTION

The present invention is described first below in connection with apparatus and method for use with a conventional saw, such as a circular power saw, to cut overlapped regions of workpieces in a manner to form a lap joint therebetween while the workpieces are secured at other regions thereof on a surface, such as a wall, floor, deck or other building surface.

That is, the apparatus and method can be practiced to cut lap joint-forming surfaces on overlapped end regions of workpieces in-situ on a wall, floor, deck or other building surface after other regions of the workpieces are already secured on the surface. Alternatively, the apparatus and method can be practiced to cut lap joint-forming surfaces at overlapped regions of the workpieces while the workpieces are disposed on a work table with the other, non-overlapped regions of the workpieces clamped or otherwise temporarily secured on the work table.

The present invention can be practiced to cut lap joint-forming surfaces on workpieces of various types such as including, but not limited to, moldings, siding, boards, fascia boards, decking, and floor boards. The workpieces that can be cut can include, but are not limited to, boards, panels, and strips which are made of wood, plastic (e.g. polymeric resin material), plastic/wood composites, metal, and cement and other materials.

Figure 1:
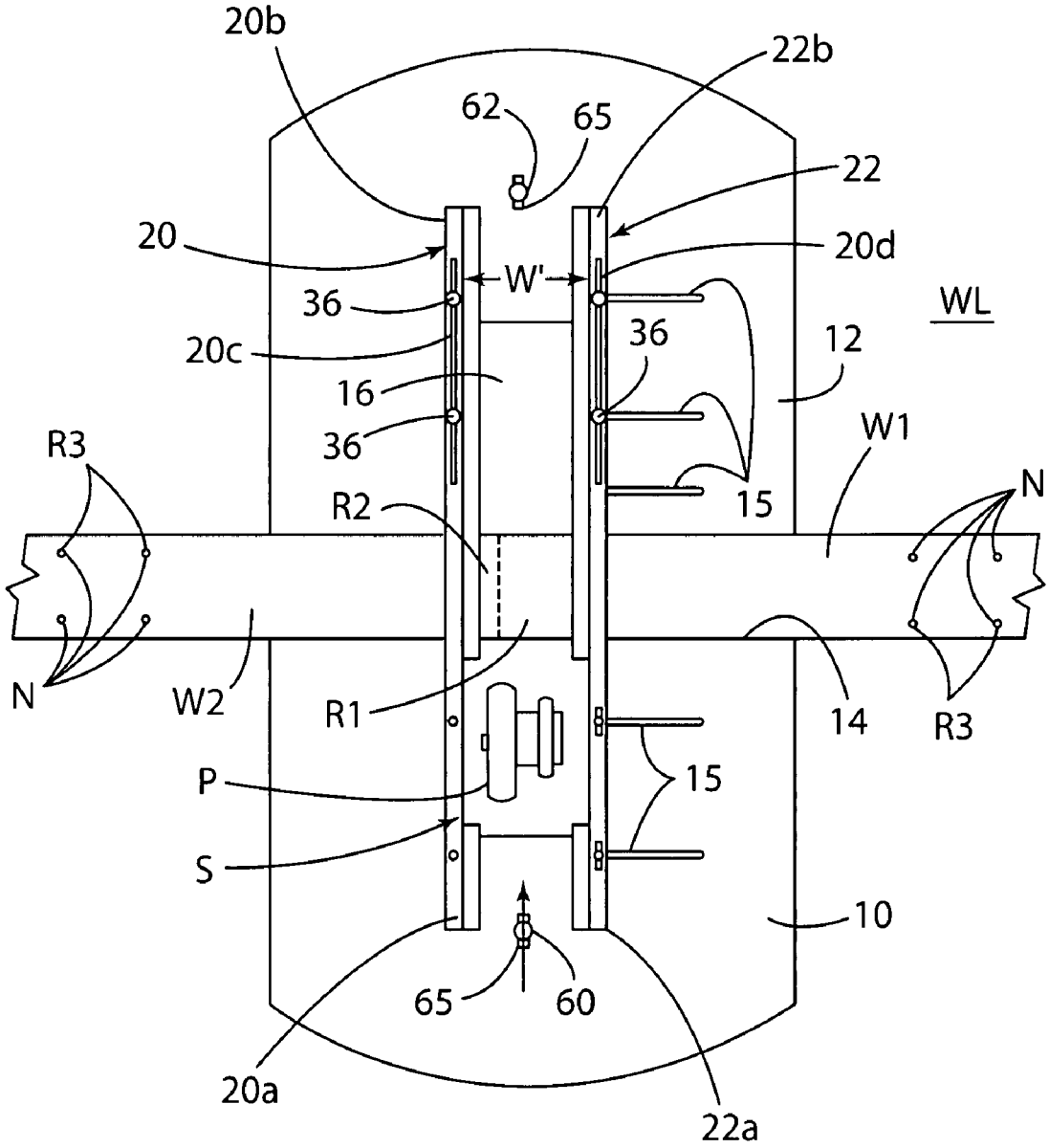
FIG. 1 is a plan view of an apparatus pursuant to an embodiment of the invention for cutting overlapped end regions of molding on a wall to form a lap joint pursuant to a method embodiment of the invention.
Figure 2:
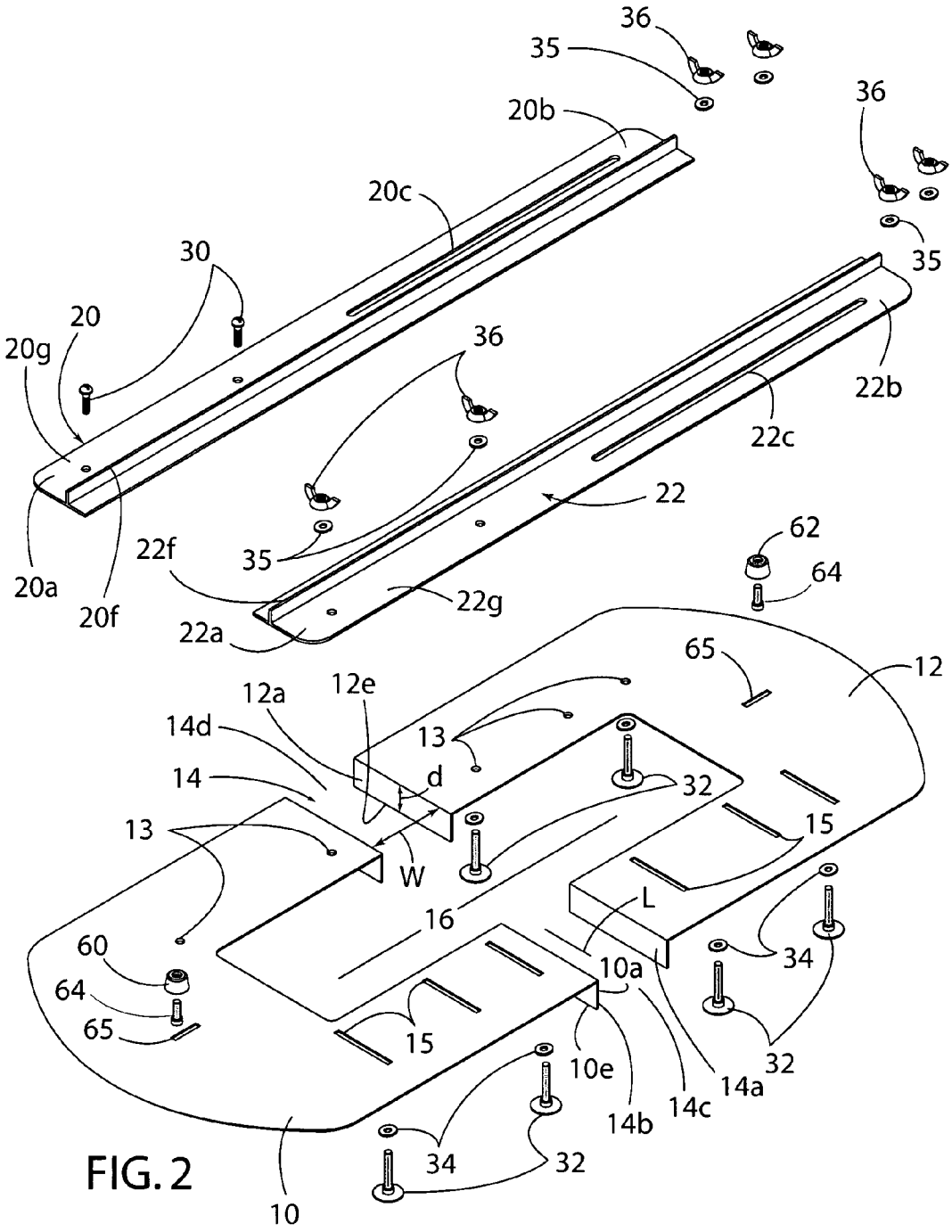
FIG. 2 is an exploded view of the apparatus.
Figure 3:
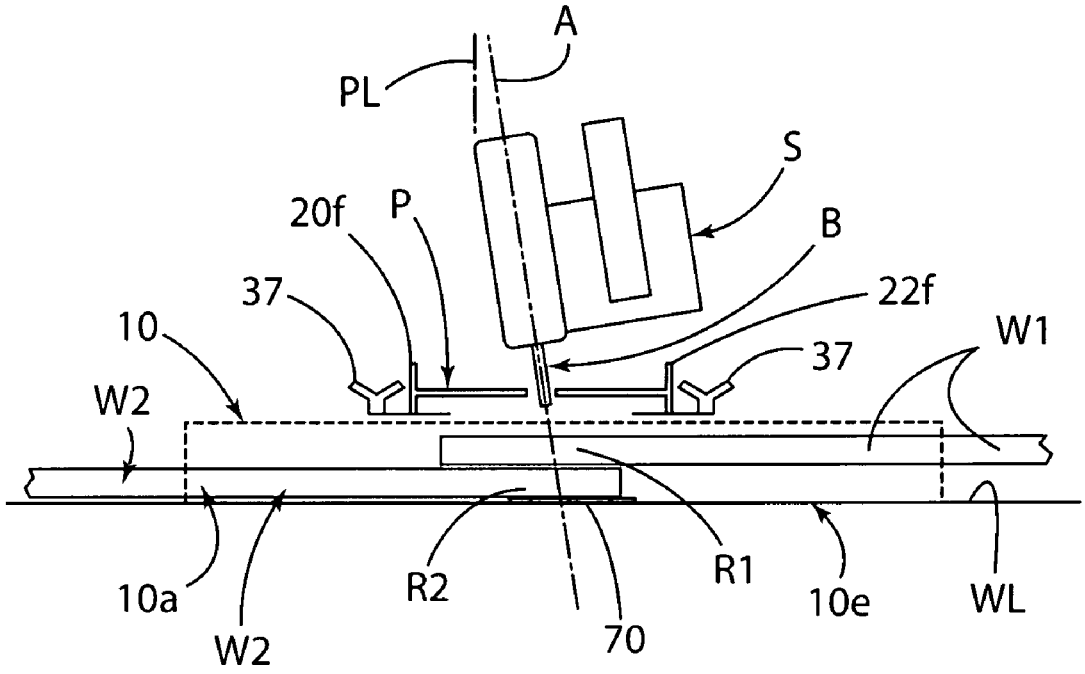
FIG. 3 is a side elevational view of a pair of overlapped end regions of workpieces ready for cutting using a circular power saw pursuant to a method embodiment of the invention. The flange 10 is shown in dashed lines to reveal the workpieces residing in the channel.

Referring to FIGS. 1-3, apparatus pursuant to an illustrative embodiment of the invention is shown for use with a circular power saw S having a saw blade (cutter) B for cutting first and second workpieces W1, W2 to form a lap joint at overlapped end regions R1, R2 thereof wherein the region R1 of the first workpiece W1 overlaps the region R2 of the second workpiece W2.

The apparatus is illustrated as including first and second channel-forming members 10, 12 collectively forming an elongated channel 14 having open channel sides 14*a*, 14*b* and open channel ends 14*c*, 14*d*. Open side 14*b* is adapted to be positioned adjacent the wall WL on which the workpieces W1, W2 are to be fastened and to receive the overlapped end regions R1, R2 thereof without the need to disassemble the apparatus. The channel-forming members 10, 12 are shown for purposes of illustration and not limitation as generally flat, plate-shaped members which can be made of metallic material, such as aluminum or aluminum alloy, steel, stainless steel, and the like, plastic, or any other suitable material. The channel-forming members 10, 12 include respective flanges 10*a*, 12*a* that typically are bent or otherwise provided thereon to form the channel 14 therebetween. The channel 14 is provided with a depth dimension, d, that is normal or perpendicular to the major plane of the members 10, 12 sufficient to receive the collective thickness of the overlapped end regions R1, R2 and a width dimension, w, between the flanges 10*a*, 12*a* sufficient to receive the width dimension of the overlapped end regions R1, R2. For purposes of illustration and not limitation, the apparatus can be configured to cut a collective thickness of 2¼ inches with a saw that has a cutting capacity to depth of 2⅜ inches. For example, first and second boards each having a thickness of 1⅛ inch can be cut. As will be described below, the width dimension w of the channel 14 can be adjusted to accommodate overlapped workpieces of different widths (e.g. boards of different width such as 1 ×2, 1×4, 1×6, 1×8, 1×10, 1×12, etc.).

The channel-forming members 10, 12 together include a saw blade (cutter)-receiving opening 16, which typically is elongated to extend in a direction transverse to the channel 14 although the opening 16 can have any shape and dimension to accommodate the saw blade B, FIG. 3, as the overlapped end regions R1, R2 are being cut. Preferably, the saw blade-receiving opening 16 extends substantially perpendicular to the longitudinal axis L of the channel 14. The opening 16 can be machined, stamped, or provided by any suitable technique in the channel-forming members 10, 12. The opening 16 can accommodate a power saw that pivots to the right or left, see FIG. 3, and the direction of overlap of the workpieces in the channel 14 is dependent on the direction of saw pivoting. For example, with reference to FIG. 3 where the saw pivots to the left in the figure, the left hand workpiece W2 in the figure is the lowermost. When the saw pivots to the right in the figure, the right hand workpiece W1 in the figure is arranged as the lowermost.

The channel-forming members 10, 12 are connected together by first and second elongated saw guides 20, 22, although one or more saw guides can be employed more generally. The saw guides 20, 22 can comprise separately formed saw guide members fastened to the channel-forming members 10, 12 as described below. The saw guides 20, 22 are disposed on the first and second channel-forming members 10, 12 typically on opposite sides of the saw blade-receiving opening 16 and extend in the same direction transverse, preferably perpendicular, to the longitudinal axis L of the channel 14 so as to receive a power saw S, FIG. 3, in a manner that its cutting blade B is guided to cut across the overlapped regions R1, R2 residing in the channel 14. In particular, the saw guides 20, 22 include respective guide flanges 20*f*, 22*f* projecting from base regions 20*g*, 22*g* thereof and between which flanges 20*f*, 22*f* the base plate P of the saw S is positioned and guided.

The first and second saw guides 20, 22 are shown connected to the first and second channel-forming members 10, 12 in a manner that allows relative movement therebetween to adjust the width dimension w of the channel 14. In particular, ends 20*a*, 22*a* of the first and second saw guides are connected to the first channel-forming member 10 using threaded fasteners 30, 32 received in holes 13 and slots 15 in the channel-forming members 10, 12. Fasteners 32 are cooperatively associated with washers 34, 35 and internally threaded nuts 36 (shown as wing nuts) to provide for saw guide adjustment as described below. The other opposite ends 20*b*, 22*b* of the first and second saw guides 20, 22 are adjustably connected to the second channel-forming member 12 to allow movement thereof relative to the first channel-forming member 10 in a direction preferably perpendicular to the longitudinal axis L of the channel. In particular, the opposite ends 20*b*, 22*b* include adjustment slots 20*c*, 22*c* to receive threaded fasteners 32 adjustably connecting the ends 20*b*, 22*b* to the second channel-forming member 12. The fasteners 32 are associated with washers 34, 35 and internally threaded nuts 36 in order to releasably and adjustably fasten the ends 20*b*, 22*b* to second channel-forming member 12 although the invention is not limited thereto since any fastener system can be used to this end. Adjustment is achieved simply by untightening the nuts 36 at ends 20*b*, 22*b*, moving the channel-forming member 12 toward or away from channel-forming member 10, and then retightening the nuts 36 at ends 20*b*, 22*b*.

The saw guides 20, 22 also may be adjustable relative to one another to accommodate power saws S having saw base plates P of different width dimension. In particular, the first and second channel-forming members 10, 12 each includes adjustment slots 15 extending substantially parallel to the longitudinal axis L. The slots 15 receive threaded fasteners 32 cooperatively associated with washers 34, 35 and internally threaded nuts 36 (shown as wing nuts) in a manner to releasably and adjustably connect the channel-forming members 10 ,12 and saw guide 22 such that saw guide 22 is movable relative to saw guide 20 when the wing nuts 36 are untightened. The saw guide 22 can be moved to adjust the width dimension w' between the first and second saw guides 20, 22 for a particular saw base plate P. Adjustment is achieved simply by untightening the nuts 36 associated with saw guide 22, moving the saw guide 22 toward or away from saw guide 20, and then retightening the nuts 36 of saw guide 22.

The saw guides 20, 22 optionally may be made longer than shown in the figures or they may be provided with separate extension arms (not shown) for connection thereto to further adjust the width dimension w of the channel 14 to accommodate overlapped workpieces of larger widths. For example, extensions arms can be provided for connection to the saw guides 20, 22 to accommodate plywood having a width from 12 inches to 24 inches, other extension arms can be provided to accommodate plywood having a width from 24 inches to 36 inches, and so on in 12 inch or other width increments.

First and second saw stops 60, 62 are disposed on the respective first and second channel-forming member 10, 12 at opposite ends of the saw blade-receiving opening 16 so as to engage the saw base plate P before the saw blade contacts the channel-forming members. The saw stops 60, 62 can comprise rubber stoppers and are connected to the channel-forming members using threaded fasteners 64 extending through elongated slots 65 in the channel-forming members so that the saw stops are adjustable in position along the longitudinal axis L for a particular saw base plate P.

Figure 2A:
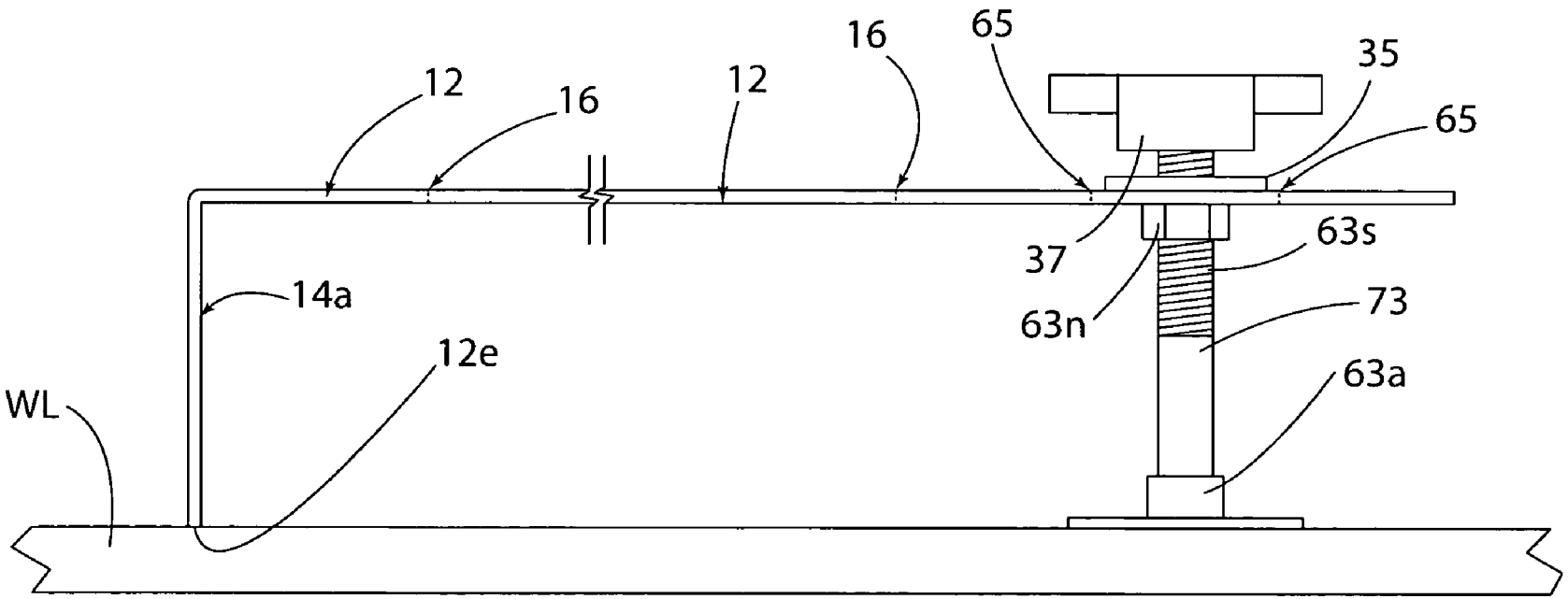
FIG. 2A is an elevation view of a channel-forming member having an elevator support bolt as a saw stop.

The first and second saw stops 60, 62 shown in FIG. 2 can be replaced by respective first and second modified saw stops each taking the form of an elevator support bolt 63, FIG. 2A. Each elevator support bolt 63 has a threaded shaft 63*s* extending through the respective slot 65 and an enlarged wall-contacting base region 63*a* for contacting the surface of wall WL. A pair of threaded nuts 63*n* are threaded on the threaded shaft of each elevator bolt 63 on opposite sides of respective channel-forming members 10, 12 as shown for channel-forming member 12 in FIG. 2A such that the flat end surface of the base region 63*a* contacts the wall surface when the edges 10*e*, 12*e* of flanges 10*a*, 12*a* contact the wall surface. That is, the flange edges 10*e*, 12*e* and the flat end surface of the base region 63*a* reside generally in a common plane. Use of the first and second elevator support bolts 63 in the respective slots 65 of channel-forming members 10, 12 reduces tipping of the apparatus during movement of the power saw along the saw guides 20, 22. The nuts 63*n* that reside on the side of the channel-forming members 10, 12 where the saw guides 20, 22 reside function as saw stops. This aspect of the invention is not limited to use of elevator support bolts 63 and can be practiced using other support members that can be connected to the channel-forming members 10, 12 in a manner that a region thereof contacts the wall surface when the flange edges 10*e*, 12*e* contact the wall surface during cutting.

Figure 2B:
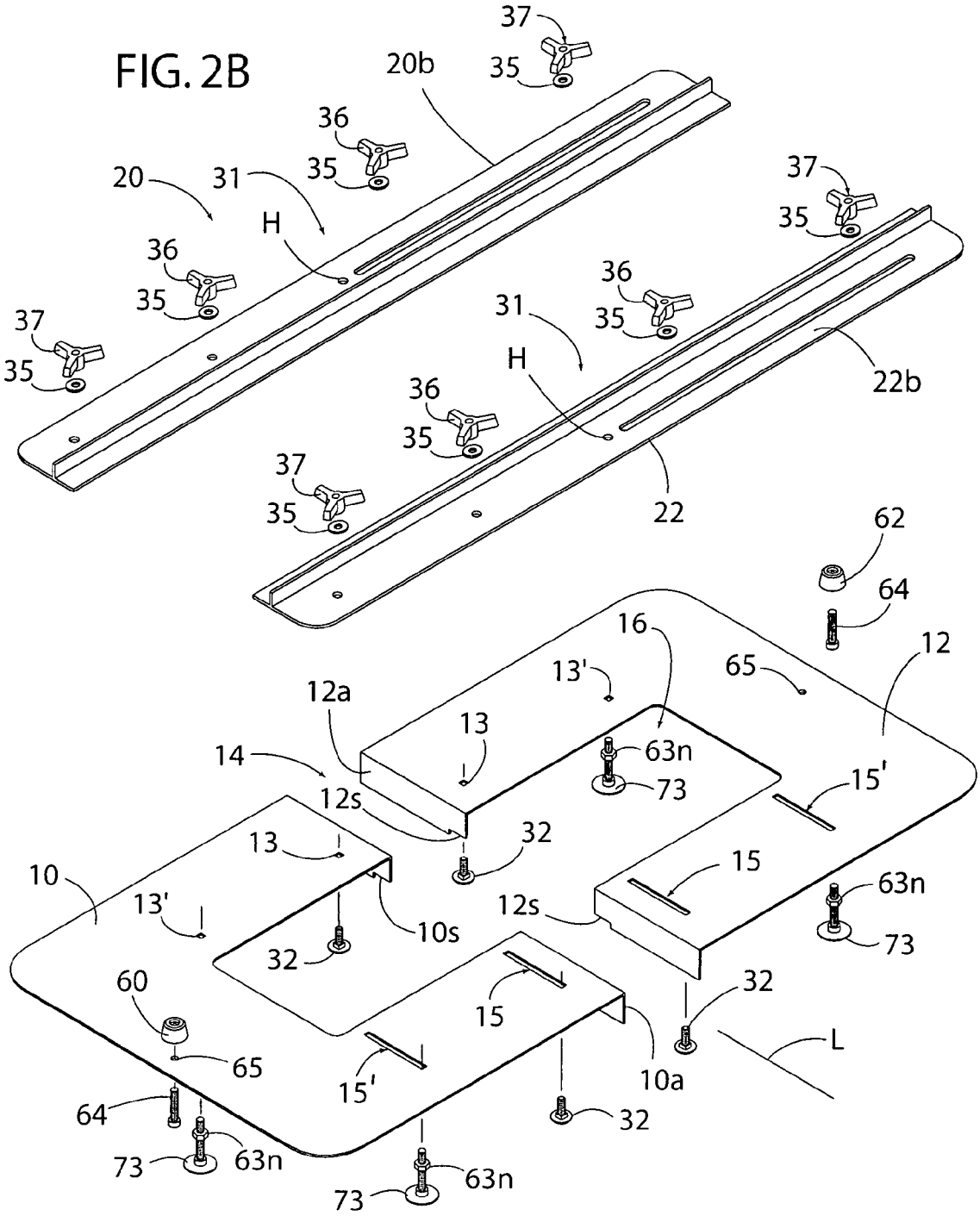
FIG. 2B is an exploded view of apparatus pursuant to another embodiment of the invention.

FIG. 2B illustrates another slightly different embodiment of the invention wherein like reference numerals are used to designate like features of FIG. 2. The embodiment of FIG. 2B differs from that of FIG. 2 in having four elevator bolts 73 providing height adjustable legs and extending through holes 13' and slots 15' instead of the threaded fasteners 30 and 32 at those locations in FIG. 2. An elevator bolt 73 is received in a respective one of holes 13' and in a respective one of slots 15' as shown. Two slots 15, 15' are shown provided in each channel-forming member 10, 12 instead of the three slots 15 shown in FIG. 2. The four elevator bolts 73 provide uniform support of the apparatus on the wall or other working surface during the lap cutting process. A washer 35 is disposed between each knob 36 or 37 and a respective one of the saw guides 20, 22 as shown.

Knobs 36 are provided in FIG. 2B to receive the threaded shafts of the fasteners 32, which replace fasteners 30 of FIG. 2. Knobs 36 and fasteners 32 are tightened together to hold the saw guides 20, 22 and channel-forming members 10, 12 tightly together after adjustment to accommodate the workpieces W1, W2. Nuts 63*n* are used to rotate and thus adjust the height of the elevator bolts 73. Knobs 36, 37 are internally threaded to receive the threaded shafts of the fasteners 32 and the elevator bolts 73.

In addition, the saw guides 20, 22 each includes a hole H adapted to receive a screw 31 (e.g. a panhead screw) and located on the saw guides at a location to directly overlie the channel 14 and the first workpiece W1 residing therein when the workpieces W1, W2 are received in channel 14 during the lap cutting process. The screws 31 are temporarily disposed through holes H and threaded into the first workpiece W1 to hold the apparatus the workpiece W1 during the lap cutting process. The two screws 31 are removed from the first workpiece after the lap cutting process is completed.

Furthermore, each flange 10*a* and 12*a* of the channel-forming members 10 and 12 includes first and second notches or slots 10*s* and 12*s* disposed on opposite sides of the saw blade-receiving opening 16 in each member 10, 12 and adjacent the channel 14, The notches or slots 12*s* are shown to extend partially along the length of the respective flange 12*a* in a direction perpendicular to the saw blade-receiving opening 16 and parallel to the longitudinal axis L of the channel 14 to accommodate the protective thin plastic member 70 shown in FIG. 3 during the lap cutting method described below. Although only a part of one of the notches or slots 10*s* is shown in FIG. 2B, the notches or slots 10*s* on flange 10*a* are like notches or slots 12*s* in size and location. The protective member 70 is removed after the lap cutting process.

Still referring to FIG. 2B, the first and second saw stops 60, 62 can be replaced by respective elevator support bolts (not shown but similar to elevator bolts 73) and nuts (not shown but similar to nuts 63*n*) in FIG. 2B when thicker workpieces (e.g. each workpiece of 1⅛ inch thickness) are being lap cut to better support the apparatus during lap cutting.

A method embodiment of the present invention for cutting lap joint-forming surface in-situ on a vertical wall WL of a building is illustrated in FIG. 1. In practicing this embodiment, the first and second workpieces W1, W2 are shown as wainscoting boards that are initially fastened or otherwise secured on the wall WL at regions R3 remote from overlapped regions R1, R2. For example, the workpieces W1, W2 are cut to a length that is greater than the length of the wall so that the workpieces overlap at regions R1, R2 as illustrated in FIG. 2 and 3. A shim or spacer (not shown) may be placed between the wall and the workpiece W1 to orient it generally parallel to workpiece W2 at the overlapped regions. Regions R3 of the workpieces are fastened to the wall by nails or other fasteners N at one or more locations remote from the overlapped regions R1, R2, which are free and unsecured.

The channel-forming members 10, 12 are then positioned so that the overlapped regions R1, R2 reside in channel 14 as illustrated in FIG. 1. In particular, the apparatus is moved by a carpenter or other worker so that flanges 10*a*, 12*a* are positioned on opposite sides of the overlapped regions R1, R2 on the wall WL with the flange edges 10*e*, 12*e* contacting the wall so that the channel 14 receives the regions R1, R2 as shown in FIGS. 1 and 3. Disassembly of the apparatus is not required to place the overlapped regions R1, R2 in the channel 14. The width of the channel 14 can be adjusted as necessary and as described above to receive the width of the overlapped regions R1, R2. A protective thin plastic member 70 optionally may be provided in the channel 14 between the workpiece W2 and the surface of the wall WL, FIG. 3, to protect the wall from damage by the saw blade.

The circular power saw S then is positioned with its base plate P between the saw guides 20, 22. The cutting angle A of the saw blade B is set or adjusted to a small acute angle effective to cut across the overlapped end regions R1, R2 without producing a gap due to the width of the saw blade. Otherwise, if the saw blade is set perpendicular to the overlapped regions R1, R2, then a space or gap will be produced by the width of the saw blade B (between sides S1, S2 of the blade) as it cuts through the regions R1, R2 since the opposite remote end regions R3 of the workpieces are already fixed in position on the wall WL.

The cutting angle A is the angle between the major plane of the circular cutting blade B and a plane PL perpendicular to the channel-forming member 10, 12, FIG. 3.

Side S1 of the saw blade produces a first cut surface 80 on workpiece W1 having cut lines L1, L2 while the second side S2 of the saw blade produces a second cut surface 90 on workpiece W2 having cut lines L1', L2'. Surfaces 80, 90 provide lap-joint forming surfaces.

Figure 4:
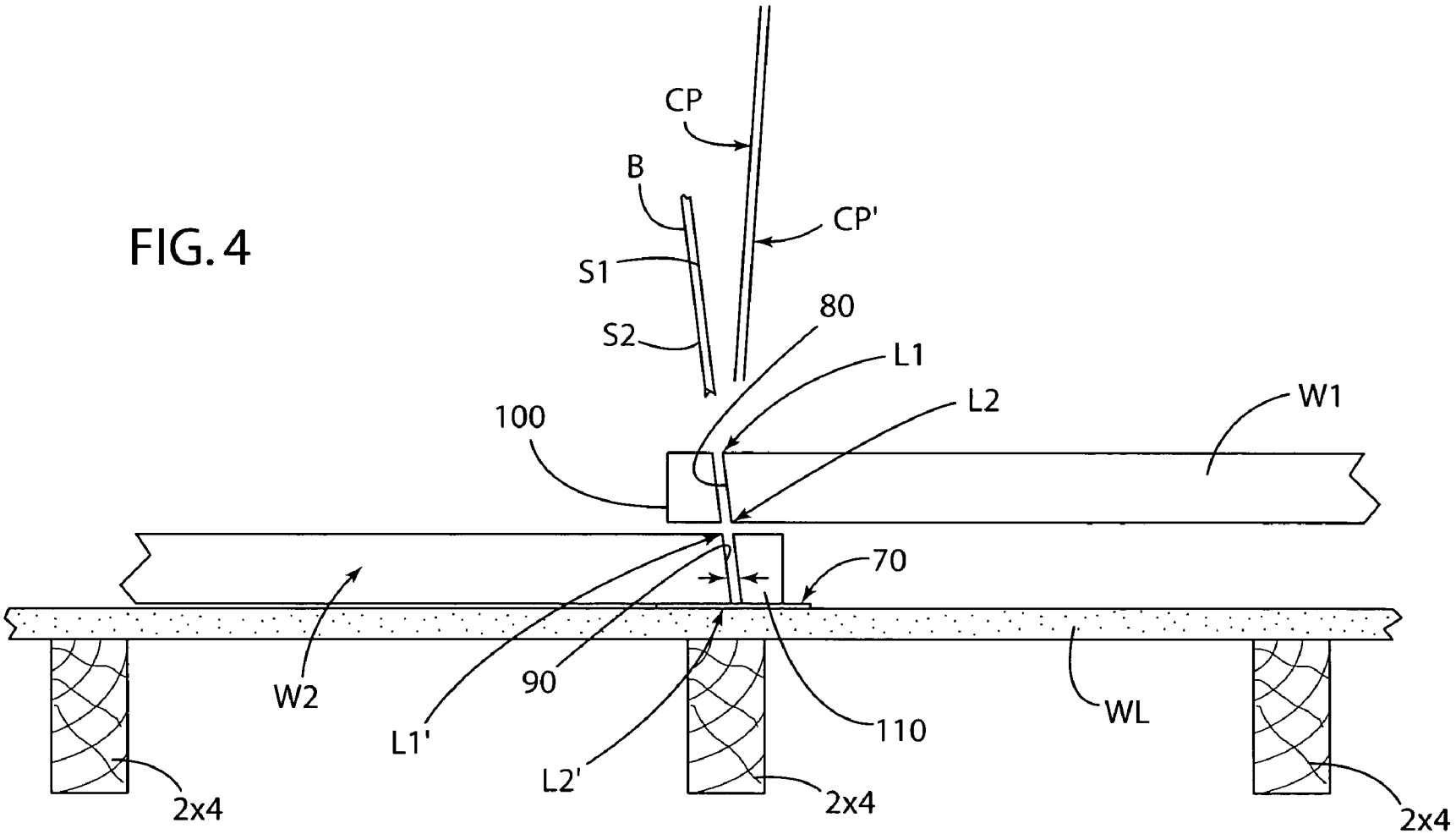
FIG. 4 is an enlarged view of the overlapped end regions showing the cut lines made by the saw blade to form the lap joint-forming surfaces.
Figure 5:
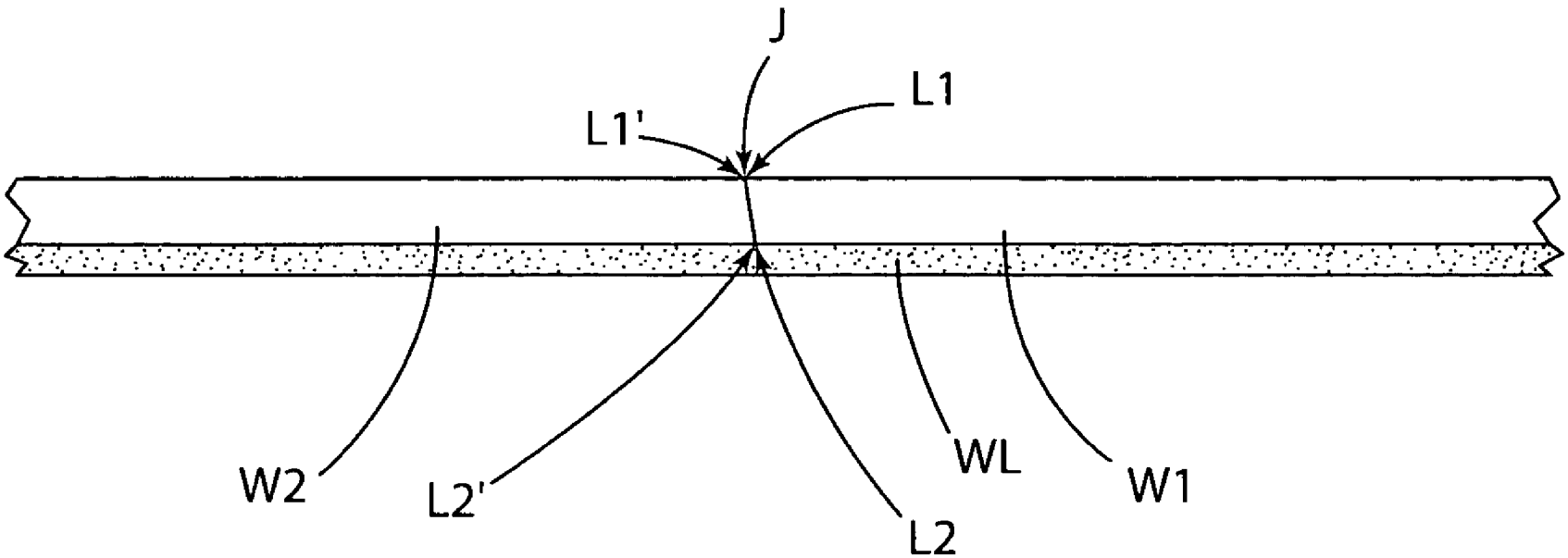
FIG. 5 shows the finished lap joint between the workpieces.

Referring to FIG. 4, the cutting angle A of the saw blade B is selected so that the initial cut line L1 of first cut surface 80 on the first workpiece W1 made by first side S1 of the saw blade lies in substantially the same plane CP as the initial cut line L1' of second cut surface 90 on the second workpiece W2 made by the opposite second side S2 of the saw blade when viewed in side elevation, FIG. 4. Similarly, the cutting angle A forms an ending cut line L2 on the first workpiece W1 made by side S1 of the saw blade that lies in substantially the same plane CP' as the ending cut line L2' on the second workpiece W2 made by opposite side S2 of the saw blade when viewed in the same side elevation. In this way, complementary lap joint-forming surfaces 80, 90 are cut on the overlapping regions R1, R2 that will mate together to form a lap joint J, FIG. 5, without a space or gap that would otherwise be produced if the saw blade cutting angle were perpendicular or at some other angle to the channel-forming members. For workpieces such as overlapped 1×6 boards each having a thickness of 0.75 inch, the cutting angle of the saw blade is about 5 to about 10 degrees, such as about 6 to about 10 degrees, relative to the vertical plane PL in FIG. 3 to this end. The cutting angle A of the saw blade B will be adjusted accordingly to accommodate the particular thicknesses of the saw blade (i.e. dimension between sides S1 and S2). Cutting of lap joint-forming surfaces 80, 90 as described leaves scrap pieces 100, 110 of the workpieces W1, W2 to be discarded.

After the overlapped regions R1, R2 have been cut by saw S, the channel-forming members 10, 12 are removed from the wall WL. The still unsecured lap joint-forming surfaces 80, 90 are positioned together to form the lap joint J. The overlapped regions R1, R2 then are secured on the wall WL by nailing or other conventional fastening technique. For example, finishing nails can be driven through the overlapped regions R1, R2 forming the lap joint J to secure the regions R1, R2 on the wall WL.

The present invention thereby provides a method of cutting overlapped end regions of workpieces to form a lap joint in a manner that overcomes the disadvantages of past cutting techniques.

Although the apparatus for cutting the lap joint surfaces has been described above as having first and second channel-forming members 10, 12, those skilled in the art will appreciate that the invention is not so limited since a single channel-forming member having the above described features may be used in certain job situations and greater than two channel-forming members may used in other job situations.

Figure 6:
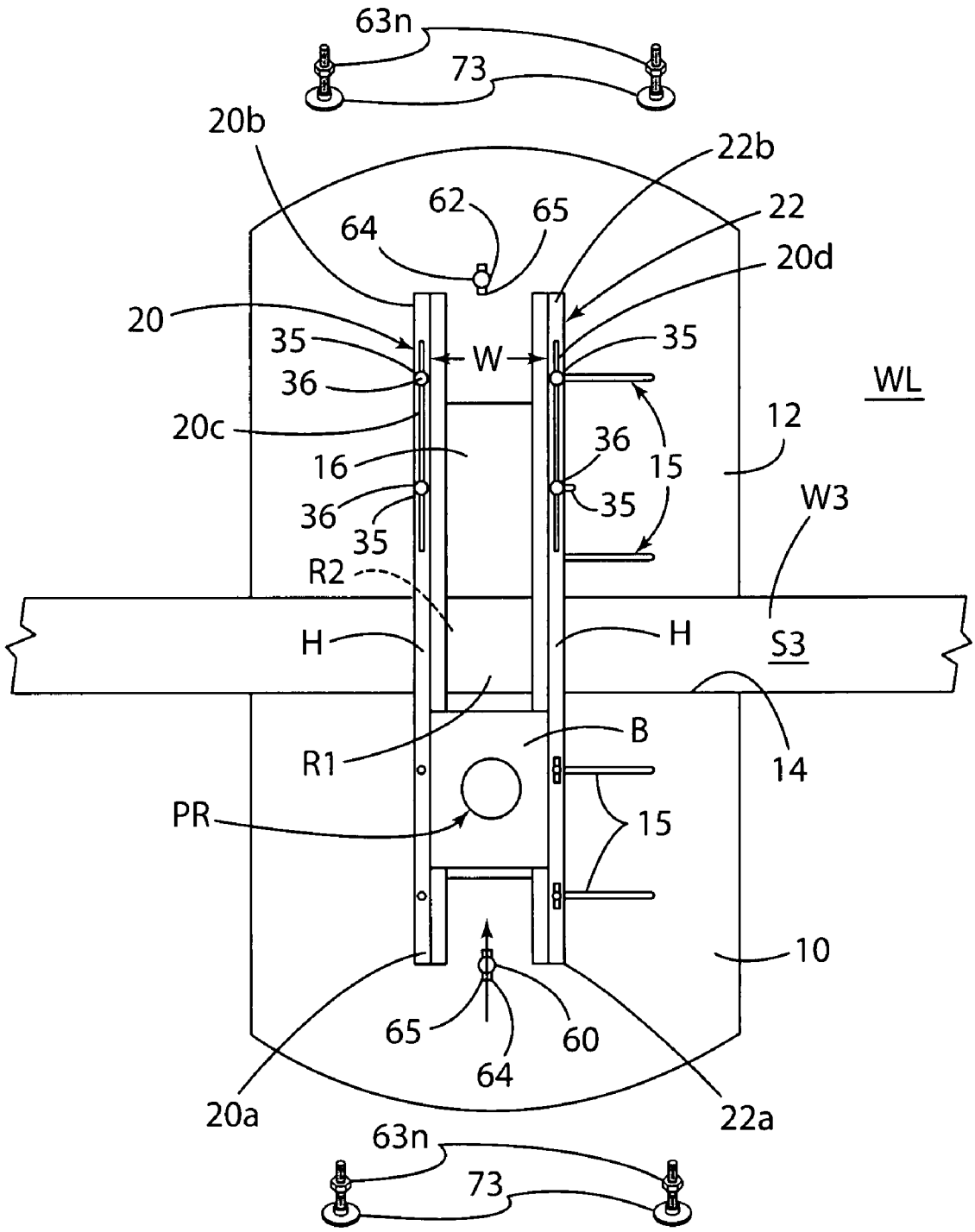
FIG. 6 is a plan view of an apparatus pursuant to an embodiment of the invention for guiding a router tool relative to a workpiece to cut a groove therein.

The present invention is now described below in connection with apparatus and method for use with a conventional router, such as an electrical or battery powered router, to cut a groove or routed region in a workpiece while the workpiece is secured in the apparatus. Referring to FIG. 6 where like features of the apparatus of FIG. 2B are designated with like reference numerals, a power router PR is disposed with its base B received between the first and second guides 20, 22. A workpiece in the form a wooden shelving board W3 is received and held in the channel 14 defined between the channel-forming members 10, 12. The board W3 can rest on a work table (not shown) in this embodiment with its major flat side S3 facing upwardly. The router PR is moved along the guides 20, 22 by a carpenter as guided by engagement of the base B in the guides 20, 22 in order to cut a groove in the side S3 of the board W3. The elongated cutter (e.g. cutting tool bit) of the router extends through the opening 16 in the channel-forming members 10, 12 so as to engage and cut the side S3 to form the groove therein.

Further, although the invention has been described above with respect to certain embodiments, these are offered for purposes of illustration since changes, modifications and the like may be made thereto within the scope of the invention as set forth in the appended claims.

I claim:

1. Apparatus for use with a cutting tool in cutting a workpiece, comprising first and second channel-forming members collectively forming an elongated workpiece receiving channel therebetween having an open side to receive a workpiece during cutting thereof, said first and second channel-forming members collectively having a cutter-receiving opening in which a cutter of the cutting tool moves to cut across the workpiece residing in the channel, and first and second tool guides disposed on said first and second channel-forming members on opposite sides of said cutter-receiving opening and extending in a direction transverse to the channel so as to guide cutting tool movement in a manner that the cutter thereof cuts across the workpiece residing in the channel, said first and second tool guides adjustably connecting the channel-forming members so that the first and second channel-forming members are movable relative to one another to adjust a width of the channel.

2. The apparatus of claim 1 wherein the first and second channel-forming members include respective first and second flanges that are facing and spaced apart in substantially parallel relation to form the workpiece-receiving channel and further include respective first and second portions of the cutter-receiving opening intersecting the workpiece-receiving channel.

3. The apparatus of claim 1 wherein the cutter-receiving opening and the first and second tool guides extend perpendicular to a longitudinal axis of the channel.

4. The apparatus of claim 1 wherein the first and second tool guides are adjustable relative to one another.

5. The apparatus of claim 1 wherein the first and second tool guides each includes a hole that overlies the channel to receive a temporary screw.

6. The apparatus of claim 1 including at least one tool stop disposed on one or both of the channel-forming members at an end of the cutter-receiving opening.

7. The apparatus of claim 6 wherein the tool stop includes a wall-contacting region.

8. The apparatus of claim 1 wherein the channel-forming members include a plurality of adjustable legs that are adapted to rest on a surface.

9. The apparatus of claim 1 wherein the first and second tool guides are spaced apart to guide a saw.

10. The apparatus of claim 1 wherein the first and second tool guides are spaced apart to guide a router.

11. Apparatus for use with a power saw in cutting workpieces to form a lap joint, comprising first and second channel-forming members collectively forming an elongated workpiece-receiving channel therebetween having an open side to receive overlapped regions of first and second workpieces during cutting thereof, said first and second channel-forming members collectively having a saw blade-receiving opening in which a cutting blade of the power saw moves to cut the overlapped regions residing in the channel, and first and second saw guides disposed on said first and second channel-forming members on opposite sides of said saw blade-receiving opening and extending in a direction transverse to the channel so as to guide power saw movement in a manner that the cutting blade thereof is guided to cut cuts across the overlapped regions residing in the channel, said first and second saw guides adjustably connecting the channel-forming members so that the first and second channel-forming members are movable relative to one another to adjust a width of the channel.

12. The apparatus of claim 11 wherein ends of the first and second saw guides are connected to the first channel-forming member with one of the ends fixed in position to the first channel-forming member and wherein other opposite ends of the first and second saw guides are adjustably connected to the second channel-forming member to allow movement thereof relative to the first channel-forming member.

13. The apparatus of claim 12 wherein the other opposite ends of the first and second saw guides include adjustment slots to receive fasteners connecting the other opposite ends to the second channel-forming member.

14. The apparatus of claim 13 wherein said ends of the first and second saw guides are connected to the first channel-forming member by elevator bolts and said other opposite ends of the first and second saw guides are adjustably connected to the second channel-forming member by elevator bolts.

15. The apparatus of claim 11 wherein the first and second channel-forming members include respective first and second flanges that are facing and spaced apart in substantially parallel relation to form the channel.

16. The apparatus of claim 15 wherein the first and second channel-forming members are plate-shaped members and the respective first and second flanges are provided substantially perpendicularly to the respective first and second channel-forming member.

17. The apparatus of claim 11 wherein the saw blade-receiving opening and the saw guides extend perpendicular to a longitudinal axis of the channel.

18. The apparatus of claim 15 wherein the first and second flanges include first and second slots adjacent the saw blade-receiving opening.

19. The apparatus of claim 11 wherein the saw guides each includes a hole that overlies the channel to receive a temporary screw.

* * * * *